US006976377B2

(12) United States Patent
Klingen et al.

(10) Patent No.: US 6,976,377 B2
(45) Date of Patent: Dec. 20, 2005

(54) METHOD OF AND APPARATUS FOR PRODUCING TUBES OF METAL

(75) Inventors: Hermann-Josef Klingen, Moers (DE); Thomas Winterfeldt, Rheinberg (DE); Norbert Zillekens, Hückelhoven (DE)

(73) Assignee: SMS Meer GmbH, Monchengladbach (DE)

( * ) Notice: Subject to any disclaimer, the term of this patent is extended or adjusted under 35 U.S.C. 154(b) by 43 days.

(21) Appl. No.: 10/790,325

(22) Filed: Feb. 27, 2004

(65) Prior Publication Data

US 2004/0200249 A1 Oct. 14, 2004

(30) Foreign Application Priority Data

Apr. 12, 2003 (DE) ..... 103 16 910

(51) Int. Cl.[7] ..... B21B 19/08
(52) U.S. Cl. ..... 72/96; 72/208
(58) Field of Search ..... 72/69, 96, 97, 72/99, 208, 209, 342.2, 342.3, 366.2, 370.01

(56) References Cited

U.S. PATENT DOCUMENTS

| | | | | |
|---|---|---|---|---|
| 4,318,294 | A * | 3/1982 | Yoshiwara et al. | 72/97 |
| 4,501,134 | A | 2/1985 | Staat | |
| 4,928,507 | A * | 5/1990 | Staat et al. | 72/38 |
| 5,524,467 | A * | 6/1996 | Wetzels | 72/78 |
| 5,644,938 | A * | 7/1997 | Moeltner et al. | 72/96 |
| 6,497,129 | B2 * | 12/2002 | Pfeiffer et al. | 72/78 |
| 6,651,473 | B2 * | 11/2003 | Roller | 72/69 |
| 2002/0116971 | A1 | 8/2002 | Roller | |

FOREIGN PATENT DOCUMENTS

DE 101 07 567 8/2002

* cited by examiner

*Primary Examiner*—Ed Tolan
(74) *Attorney, Agent, or Firm*—Herbert Dubno

(57) ABSTRACT

In the planetary skew rolling blooms to form seamless metal tubing or pipe the internal tool is retracted at the leading and/or trailing end of the tubular bloom to allow the rolls to seal the end or ends and prevent coolant from entering the rolled tubing or bloom. The internal tool is advanced back into its normal rolling position after the end has passed the rolling location.

15 Claims, 3 Drawing Sheets

METHOD OF AND APPARATUS FOR PRODUCING TUBES OF METAL

FIELD OF THE INVENTION

The present invention relates to a method of producing tubes or pipes of metal and, more particularly, to a method of producing metal tubing in a planetary skew rolling mill. The invention also relates to an apparatus for producing metal tubing or metal pipe.

BACKGROUND OF THE INVENTION

The fabrication of seamless tubular metal bodies from metal workpieces, for example a tubular bloom or a bloom of metal which is to be pierced and rolled, in a planetary skew rolling mill by rolling the bloom between a plurality of rolls which are usually conical, around a mandrel-like tool in the interior of the workpiece, is known.

The fabrication of seamless pipe in this manner utilizing a so-called planetary skew rolling mill is described in DE 101 07 567 (see also U.S. Pat. No. 4,501,134). A tubular bloom is supplied to such a planetary mill and is passed through a gap defined between a plurality of rolls which are rotatable about inclined axes and which roll the bloom around the mandrel-shaped internal tool.

During the rolling, significant energy is delivered to the bloom or rolled tube and the latter tends to heat up to a significant degree such that a coolant must be applied.

From DE 101 07 567 A1, therefore, it is known to effect cooling of the bloom at the region at which the bloom is deformed to a greatest extent, usually at the inlet to the gap, by spraying the cooling medium from all sides, concentrically onto the bloom. The cooling medium, generally water, is supplied at a high pressure to the gap. The cooling water removes sufficient heat so that a temperature increase of the rolled tubing is at least in part suppressed and such that an impermissible increase in temperature is prevented.

However, this technique engenders problems since, for example, the cooling medium can enter the open ends of the rolled tubing and can create difficulties in further processing. Such difficulties can arise where the liquid trapped in the tubing can form a plug or other barrier to further shaping, e.g. rolling.

When such problems can arise, the usual approach has been to try to prevent the cooling medium from entering the open end of the tubing or the bloom. This can have the disadvantage that it can reduce the rolling speed or the output of the rolling mill and even increase the reject level. Another disadvantage for avoiding the cooling at the end regions of the tubing is that the bloom or rolled tubing in these regions emerges from the mill in a hotter state than is otherwise desirable, and can easily be oxidized. The readily oxidized region of the tube must be later removed to ensure a sufficient quality of the rolled tubing.

OBJECTS OF THE INVENTION

It is, therefore, the principal object of the present invention to provide a method of producing metal tubing in a planetary skew rolling mill of the type described whereby the aforementioned drawbacks are avoided and an increase in the output of the mill and the quality of the rolled product can be ensured.

More specifically it is an object of the invention to provide a method of producing metal tubing in such a mill, whereby excess heating is eliminated as a problem without engendering any difficulties with respect to the inclusion of liquid coolant in the rolled tubing or the bloom from which it is rolled.

Another object of the invention is to increase the output of a planetary skew rolling mill and to improve the operation thereof without drawbacks arising from overheating of the rolled product.

It is also an object of the invention to provide an improved planetary skew rolling mill for the rolling of tubular metal products.

SUMMARY OF THE INVENTION

These objects are attained, in accordance with the invention in a method of producing metal tubing in a planetary skew rolling mill which comprises the steps of:

(a) advancing a tubular metal bloom between a plurality of rolls of a planetary skew rolling mill, positioning a mandrel-shaped internal tool within the bloom and rolling the bloom with the rolls against the mandrel-shaped internal tool to a reduced wall thickness of a rolled tubing in a working position of the internal tool;

(b) upon approach of an end of the bloom to a region of the rolls, withdrawing the mandrel-shaped internal tool from the working position linearly by a predetermined distance in a direction opposite a direction of advance of the bloom; and (c) upon the end passing the region of the rolls, displacing the mandrel-shaped internal tool linearly back into the position.

This method can further comprise the step of sealing the end liquid tight by compressing the end with the rolls upon withdrawal of the mandrel-shaped internal tool from the normal rolling position.

The sealed end can be the leading end of the bloom, the trailing end thereof or both the leading end and the trailing end.

According to the invention, the internal tool, namely the mandrel at the point in time at which this tool is located at the leading end or trailing end of the tubular bloom and is located in the region of the roll, is withdrawn in a direction opposite the direction of advance of the bloom from its working position by a predetermined distance and thereafter the leading end of the bloom and/or the trailing end of the bloom is sealed by the roll and after the passage of that leading end and/or trailing end, the internal tube is advanced back into its working position.

The method of the invention is more economical when at least two tubular blooms are fed through the planetary skew mill in end to end abutting relationship. In this case, the blooms can be fed continuously to and through the mill.

Because the internal tool is retracted and then advanced, the abutting ends of the rolled tube or the blooms can be sealed during the rolling process with the effect that no coolant can penetrate into the interior of the cooled tubing.

The rotation of the rolled tubing about its longitudinal axis can be measured and the drive or drives of the rolls can be controlled in response to the measurement of the rotation of the tubing. This allows control of the main roll drive or the drive superimposed upon the main drive, (i.e. any superimposed drive) to maximize the efficiency of the mill. Of course in the system of the invention, the cooling of the rolled bloom and/or the rolled tubing can be effected with a liquid medium, preferably directed onto the rolled product from all around the periphery thereof.

The planetary skew mill according to the invention thus can have an internal tool provided with a retractor and a drive for advancing the tool in order to shift the latter from and into its working position in the manner described. The drive can be a linear (e.g. hydraulic or electrical) actuator.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
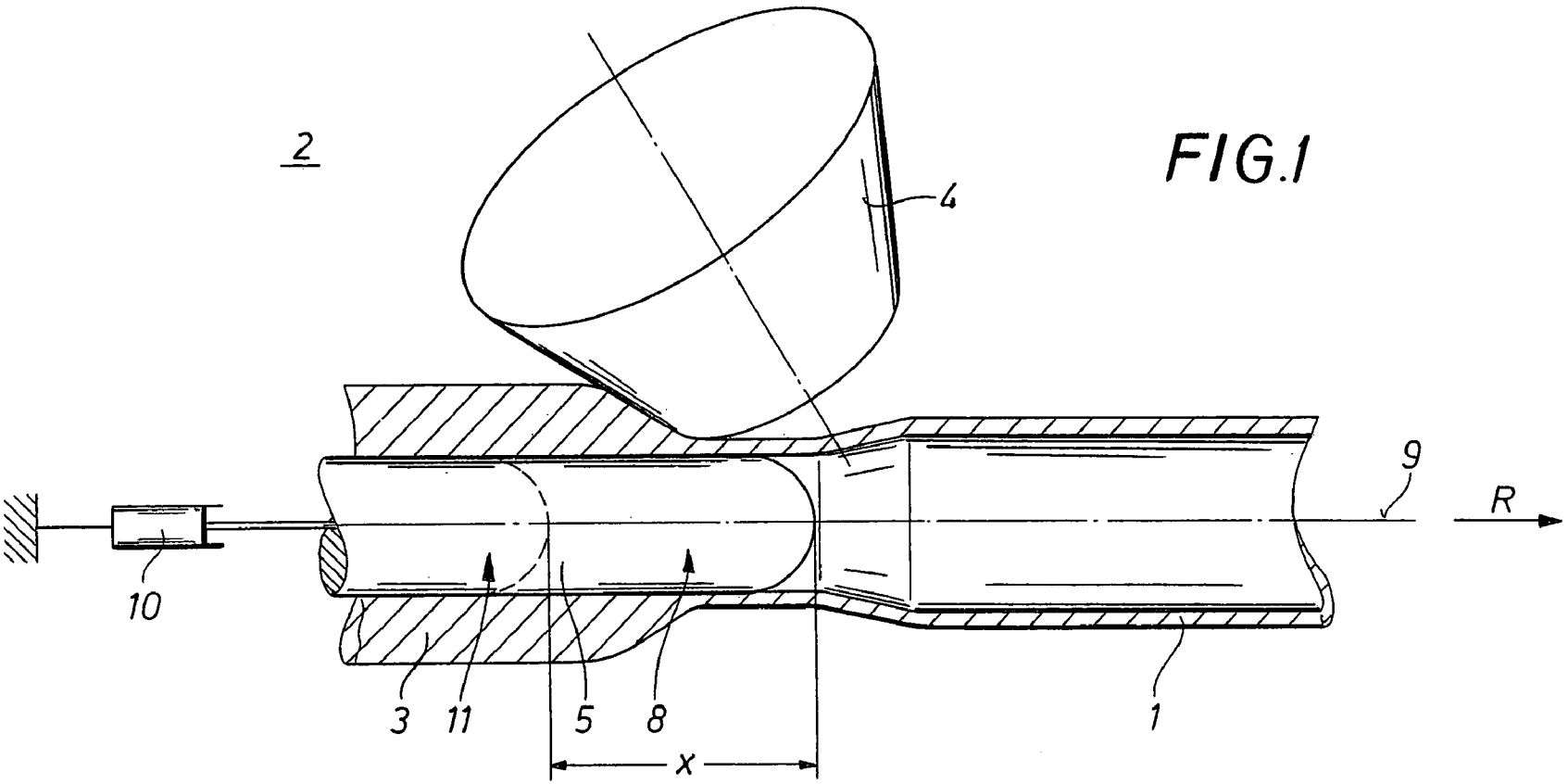
FIG. 1 is a diagrammatic axial cross sectional view showing the rolling of a tubular bloom to form a seamless pipe in the normal rolling position.

FIG. 1 schematically illustrates a planetary skew rolling mill 2 of which only one roll 4 has ben shown diagrammatically and which serves to roll a tubular bloom 3 into a seamless tube 1. The bloom 3 is advanced in the direction R and it will be understood that a number of rolls 4 are uniformly distributed around the tube 1. Furthermore, a mandrel-shaped internal tool 5 is so positioned between the tools 4 that it defines with the roll a rolling gap within which the rolls 4 roll the material of the bloom 3 to a tube 1 of the desired diameter.

Figure 2:
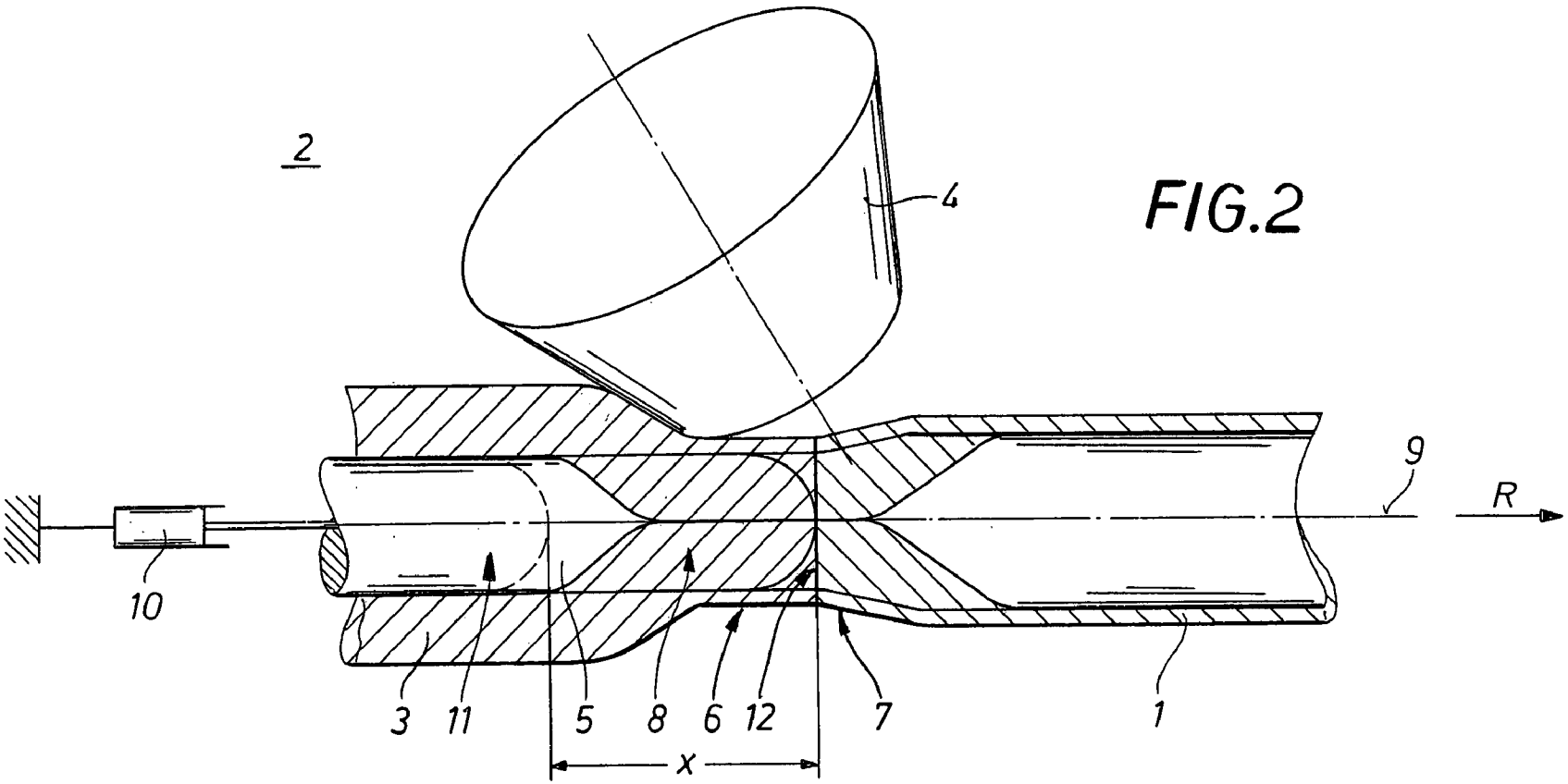
FIG. 2 is a view similar to FIG. 1 showing the regions in which two blooms abut one another and in which a seal is to be formed at the leading end of one bloom and the trailing end of another.

In the planetary skew mill 2, two blooms can be fed in axially abutting relationship so that from FIG. 2 it will be apparent that the end 7 (trailing end) of the leading bloom 3 is abutted by the leading end 6 of the following bloom 3. The abutment is represented at 12.

At the point at which these ends of two successive blooms reach the rolling region of the rolls 4, the internal tool 5 is retracted in a direction opposite the direction of advance R of the blooms by a predetermined distance x utilizing a linear actuator 10 which can be a hydraulic or electrical linear actuator. This has been shown in both FIGS. 1 and 2. In FIG. 1 the solid line position of the internal tool 5 has been represented at 8 and is the normal working position for rolling. In FIG. 2 the retracted position has been shown at 11 and is at a distance x from the normal position.

In the retracted position, as can be seen from FIG. 2, the ends 6 and 7 of the blooms are radially rolled together to seal them against the cooling liquid. As a result, no cooling medium can enter the rolled tubes or blooms and thus plugs of the coolant liquid cannot interfere with further shaping of the tubes. Furthermore, the sealing prevents the ends of the rolled tubing from leaving the mill in an excessively hot state and thus prevents excessive oxidation which can be a problem for tubing composed of copper or copper alloy.

Once the leading end 6 of the next bloom passes the rolling region, the internal tool 5 is returned to its normal working position 8 by the driver 10.

The displacement x is selected so that effective seals can be formed at the leading and trailing ends of the blooms. The system, moreover, allows the blooms to be fed in mutually abutting relationship and hence continuously through the mill.

The rotation of the tubing 1 about its longitudinal axis 9 can be measured and the measurement used to control the drives of the rolls 4 so as to compensate for rotation of the tubing 1 and, if appropriate, such that a rotation of the tubing 1 about its longitudinal axis is precluded.

Since the axial shifting of the internal tool 5 can cause a tearing at the rolled tubing ends, the automatic compensation of the tube rotation can serve to counteract any tearing effect and ensure a reliable and reproducible closure of the tube ends. One advantage of the invention is that the cooling can continue with a rolling motion even during the sealing of the tubing ends without the danger that the liquid will enter the tubing. In other words the tubing is cooled constantly during the entire process so that no oxidation can occur even though the tubing is sealed at the ends by withdrawal of the internal tool.

Figure 3:
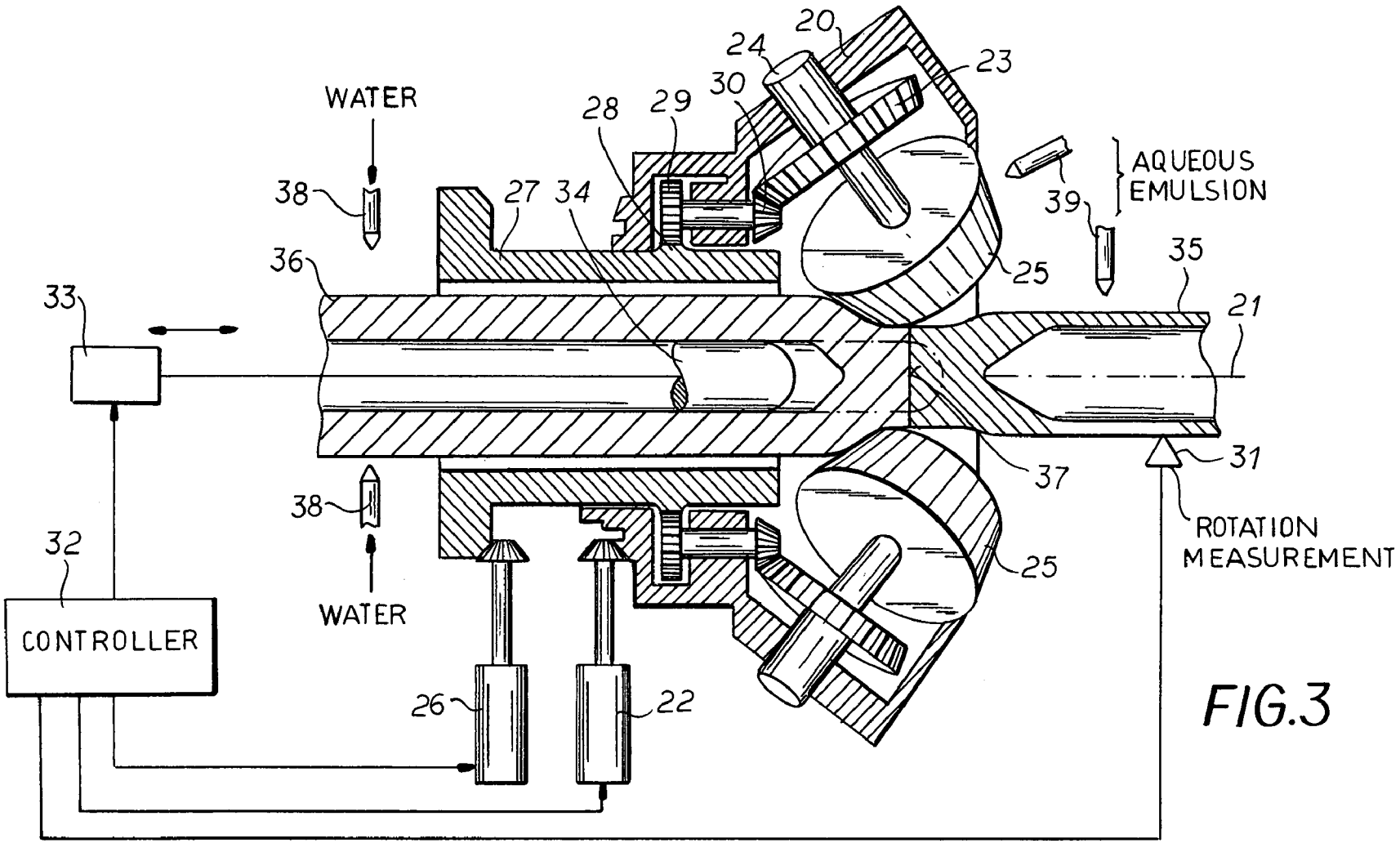
FIG. 3 is a cross sectional view of another apparatus for carrying out the method of the present invention.

In FIG. 3 we have shown a planetary skew rolling mill in which the planet carrier 20 is driven around the axis 21 by a drive 22 and the planet gears 23 connect to the shafts 24 of the rolls 25 which are driven by another drive 26 acting upon the sleeve 27 on which the carrier 20 is journaled. The sleeve 27, in turn, forms a ring gear 28 which drives the pinions 29 whose bevel gears 30 mesh with the gears 23 of the rolls 25. A rotation measurement head 31 is connected to the controller 32 and regulates the main drive 22 or the superimposed drive 26 and, of course, the controller 32 also controls the operation of the drive 33, namely the hydraulic or electrical actuator for the internal tool 34. The blooms 35 and 36 abut at 37 as has been described and the coolant is sprayed directly on the blooms as represented by the nozzles 38. The aqueous emulsion at the rolling location can be directed onto the rolls 25 and the blooms via the nozzles 39. With the apparatus of FIG. 3, the skew rolling of the blooms around the tool 34 will be apparent.

We claim:

1. A method of producing metal tubing in a planetary skew rolling mill which comprises the steps of:

(a) advancing a tubular metal bloom between a plurality of rolls of a planetary skew rolling mill, positioning a mandrel-shaped internal tool within said bloom and rolling the bloom with said rolls against said mandrel-shaped internal tool to a reduced wall thickness of a rolled tubing in a working position of said internal tool;

(b) upon approach of an end of said bloom to a region of said rolls, withdrawing said mandrel-shaped internal tool from said working position linearly by a predetermined distance in a direction opposite a direction of advance of the bloom; and (c) upon said end passing said region of said rolls, displacing said mandrel-shaped internal tool linearly back into said position.

2. The method defined in claim 1, further comprising the step of sealing said end liquid tight by compressing said end with said rolls upon withdrawal of said mandrel-shaped internal tool from said position.

3. The method defined in claim 2 wherein said end is a leading end of the bloom.

4. The method defined in claim 2 wherein said end is a trailing end of the bloom.

5. The method defined in claim 2 wherein both a leading end and a trailing end of the bloom are sealed.

6. The method defined in claim 2 wherein at least two of said blooms are fed one after another though said region and a leading end of a subsequent bloom abuts a trailing end of a preceding bloom.

7. The method defined in claim 6 wherein a succession of said blooms are fed continuously through the planetary skew rolling mill.

8. The method defined in claim 2, further comprising the steps of measuring rotation of said tubing during rolling thereof, and controlling at least one drive of the planetary skew rolling mill to compensate for rotation of the tubing about a longitudinal axis thereof.

9. The method defined in claim 8 wherein the controlled drive is a main drive of said rolling mill.

10. The method defined in claim 8 wherein the controlled drive is a superimposed drive of said rolling mill.

11. The method defined in claim 2, further comprising the step of cooling at least one of said bloom and said tubing with a liquid cooling medium.

12. A planetary skew rolling mill for producing metal tubing, comprising:

a plurality of rolls in a planetary skew rolling mill configuration and a mandrel-shaped internal tool within a tubular metal bloom for rolling the bloom with said rolls against said mandrel-shaped internal tool to a reduced wall thickness of a rolled tubing in a working position of said internal tool; and a device connected to said internal tool and effective upon approach of an end of said bloom to a region of said rolls for withdrawing said mandrel-shaped internal tool from said working position linearly by a predetermined distance in a direction opposite to a direction of advance of the bloom, and effective upon said end passing said region of said rolls for displacing said mandrel-shaped internal tool linearly back into said position.

13. The planetary skew rolling mill defined in claim 12 wherein said device is a linear actuator.

14. The planetary skew rolling mill defined in claim 12 wherein said linear actuator is a hydraulic actuator.

15. The planetary skew rolling mill defined in claim 12 wherein said linear actuator is an electrical actuator.

* * * * *